United States Patent [19]

Huruno et al.

[11] Patent Number: 5,075,692

[45] Date of Patent: Dec. 24, 1991

[54] ANTENNA SYSTEM

[75] Inventors: Takayoshi Huruno; Takashi Katagi, both of Kanagawa, Japan

[73] Assignee: Mitsubishi Denki Kabushiki Kaisha, Tokyo, Japan

[21] Appl. No.: 642,183

[22] Filed: Jan. 16, 1991

Related U.S. Application Data

[63] Continuation-in-part of Ser. No. 305,411, Feb. 1, 1989, abandoned.

[30] Foreign Application Priority Data

Feb. 4, 1988 [JP] Japan ..... 63-24132
Feb. 4, 1988 [JP] Japan ..... 63-24133

[51] Int. Cl.[5] ..... H01Q 19/180; H01Q 15/160
[52] U.S. Cl. ..... 343/781 P; 343/837
[58] Field of Search ..... 343/837, 840, 756, 781 CA, 343/781 P, 781 R

[56] References Cited

U.S. PATENT DOCUMENTS 4,109,253 8/1978 Cho ..... 343/756
4,166,276 8/1979 Dragone ..... 343/781 P
4,298,877 11/1981 Sletten ..... 343/781 CA
4,618,866 10/1986 Makino et al. ..... 343/781 P

FOREIGN PATENT DOCUMENTS 28247 6/1986 Japan ..... 343/781 P
29569 7/1986 Japan ..... 343/781 P
29570 7/1986 Japan ..... 343/781 P

OTHER PUBLICATIONS

Denshi-Tsushin Gakkai Ronbunshi, "4, 5, 6 GHz Band Offset Antenna Featuring Low Sidelobe and High Cross Polarization Discrimination", vol. J67-B, No. 2, p. 197.

Mitsubishi Denki Gihou, "Equalizing Parabolic Representations of Multiple Reflector Type Antenna and its Application", vol. 49, No. 11, pp. 729-732.

"Tri-Reflector Antennas with no Cross-Polarized Component", by Takashi Kitsuregawa et al., IEEE, 1979.

"Tri-Reflector Antennas with no Cross-Polarized Component", by S. Urasaki et al., Electronics & Communications in Japan, vol. 68, No. 8, part 1, Aug. 1985, pp. 85-92, Scripta Technica, Inc., Sussex, GB.

*Primary Examiner*—Michael C. Wimer
*Assistant Examiner*—Peter Toby Brown
*Attorney, Agent, or Firm*—Wolf, Greenfield & Sacks

[57] ABSTRACT

An antenna system in which main and subreflectors are arranged in such a manner to suppress the generation of a cross-polarized component due to the antisymmetry of the reflectors. Thereby, the antenna system can provide a preferable cross-polarization characteristics even in the working frequency bands.

2 Claims, 4 Drawing Sheets

Fig. 1 (h)
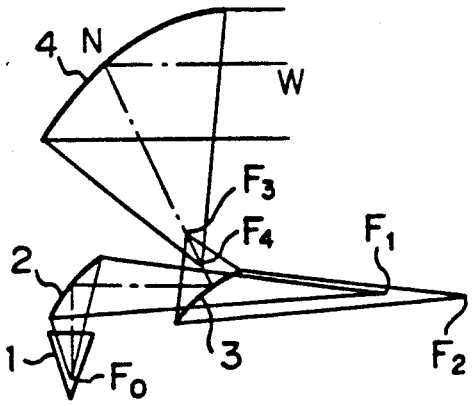
Fig. 1 (f)
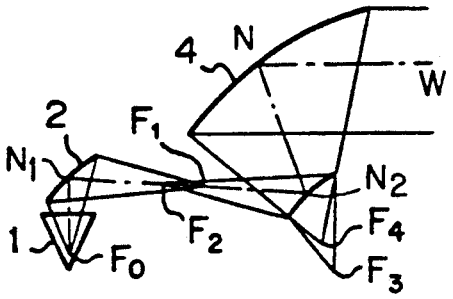
Fig. 2 (a)
(PRIOR ART)
Fig. 1 (g)
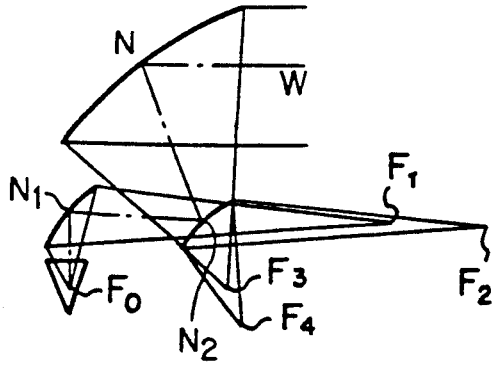
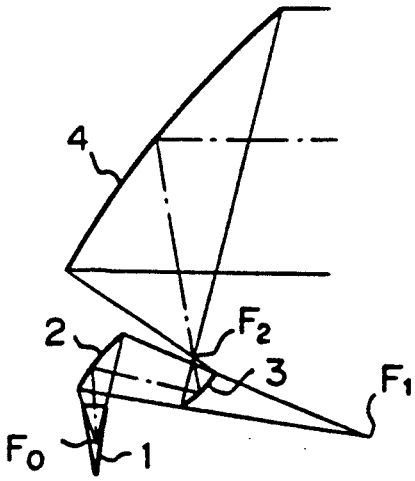
Fig. 1 (a')
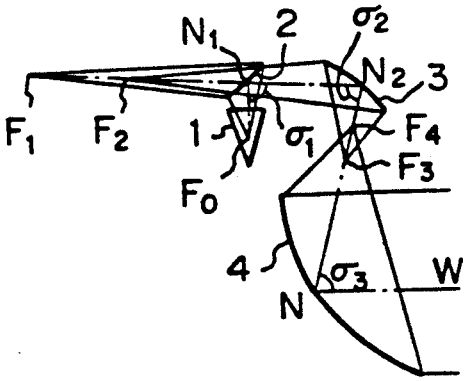
Fig. 2 (b)
(PRIOR ART)
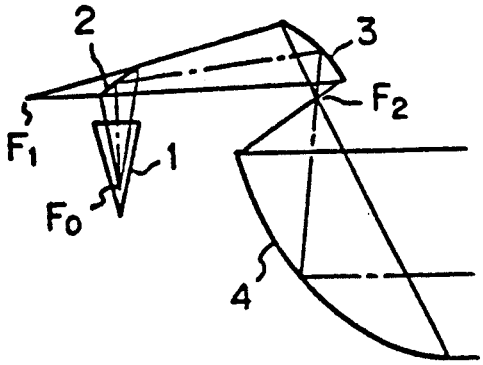

Fig. 1 (e')
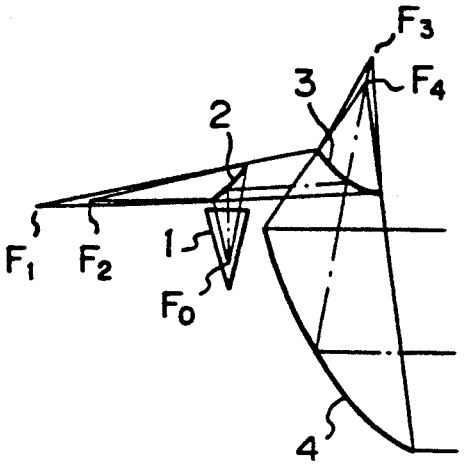
Fig. 3
(PRIOR ART)
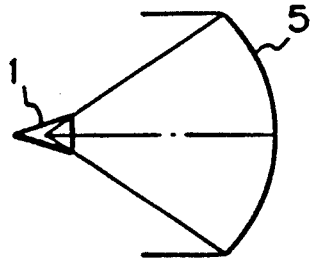
Fig. 4
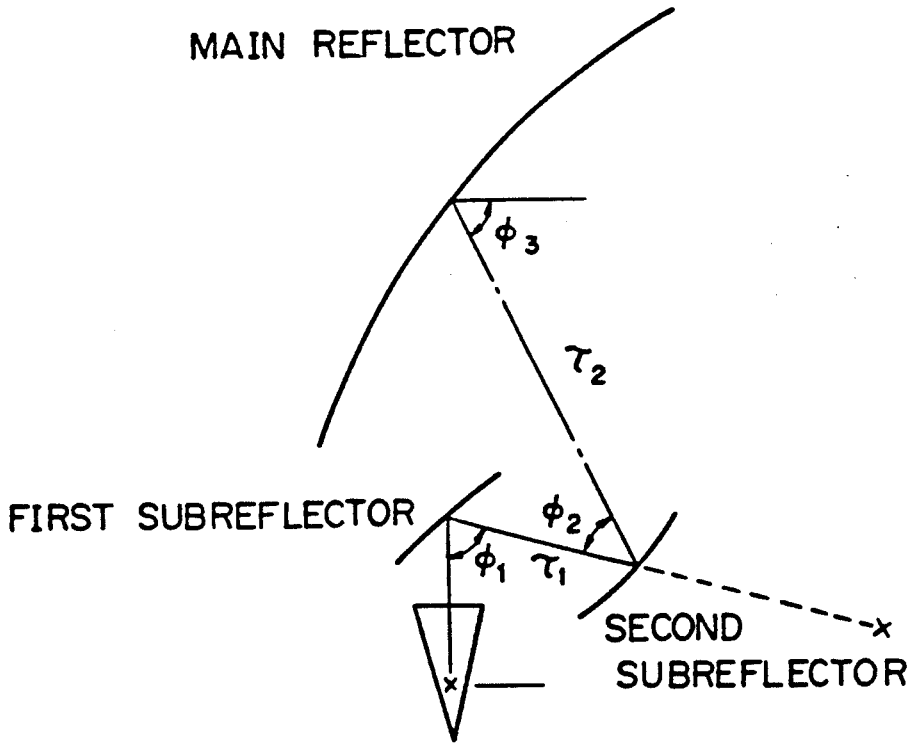

ANTENNA SYSTEM

RELATED APPLICATION

This application is a continuation-in-part of the application Ser. No. 07/305,411 filed on Feb. 1, 1989, now abandoned.

BACKGROUND OF THE INVENTION:

1. Field of the Invention

The present invention relates to an improvement of antenna system for use in a ground trunk system and so on.

2. Description of the Prior Art

Among the prior art antenna systems of the type which includes a main reflector, subreflectors and a primary radiator, there has been developed an improvement having wide-angle radiation characteristics by employing an anti-symmetrical mirror and disposing the subreflectors, primary radiator and a supporting pole in such a manner not to cause blocking.

This prior art antenna system, however, has a drawback in that a cross-polarized component can be generated because the mirror is not of rotation symmetry. To eliminate the above described defect, there has been developed another conventional antenna system which is provided with a conical horn 1 having a phase center $F_0$ as a primary radiator, a first subreflector 2 having the phase center $F_0$ of the conical horn 1 in common and further a focal point $F_1$, a second subreflector 3 having the focal point $F_1$ in common and further a focal point $F_2$ and a main reflector 4 having a focal point $F_2$ in common, as shown in FIGS. 2(*a*) and 2(*b*).

In the antenna systems shown in these figures, the first and second subreflectors 2 and 3 are a rotary elliptic reflector and rotary hyperbolic reflector, respectively. Further, the main reflector 4 is a rotary parabolic reflector. For the purpose of suppressing the generation of the cross-polarized component due to the anti-symmetry of the mirror, each of these prior art antenna systems are geometro-optically constructed such that the system of the reflectors is equivalent to a parabolic antenna as shown in FIG. 3. In this figure reference numeral 5 indicates a parabolic mirror having rotation symmetry.

However, in this antenna system, the cross-polarized component can be completely suppressed in case wherein the frequency of a beam emitted therefrom is infinite because the system of the mirrors is geometro-optically designed as described above. Thus, in a practical working frequency band such as microwave and millimeter-wave bands, the cross-polarized component generated due to the anti-symmetry of the reflectors cannot be completely eliminated. As a result, this conventional antenna system has a further drawback in that the cross-polarization characteristics thereof are deteriorated in the working frequency band.

Further, it is described in the Japanese Registered Patent Nos. 1361802 and 1364819 (refer to the Japanese Patent Application Publication Nos. 28247/1986 and 29570/1986 Official Gazettes) that geometro-optically obtained conditions of suppressing the cross-polarized component are given by:

$$e_1^2-1=-\{4L_0\sin^2[(\theta_0-\alpha)/2]\}(L_0+1)^2 \quad \text{(p1)}$$

and $$e_2^2-1=\{4\sin[\beta-\gamma)/2]\sin[(\alpha-\gamma)/2]\sin(\beta/2)\sin(\alpha/2)\}/\sin^2[9\alpha+\beta-\gamma)/2] \quad \text{(p2)}$$

where $e_1$ and $e_2$ denote eccentricities of the curvatures of the first and second subreflectors, respectively, and furthermore $\gamma$ is given by $$\tan\{(\gamma-\alpha)/2=\{L_0\tan(\theta_0-\alpha)/2\}/(1+L_0) \quad \text{(p3).}$$

These conditions of suppressing the cross-polarized component in the prior art differ from those of suppressing the cross-polarized component according to the present invention which are obtained by taking the wave nature of the electric wave into consideration and will be described hereinafter. First, in the conditions of suppressing the cross-polarized component in the prior art, the eccentricities $e_1$ and $e_2$ of the subreflectors which satisfy the geometro-optically obtained conditions of suppressing the cross-polarized component are determined only by the geometrical arrangement of the subreflectors positions of which are represented by, for example, polar coordinates. Further, the arrangement of the reflectors are limited in such a manner that they have common focal points. Moreover, the geometro-optical technique of suppressing the cross-polarized component is carried out to eliminate the cross- polarized component in the frequency range of light and has a disadvantage in that, in the frequency range of microwave, such technique cannot suppress all of the cross-polarized components.

It is therefore a primary object of the present invention, which is accomplished to obviate such defects of the prior art, to provide an improved antenna system which has a preferable cross-polarization characteristics in the working frequency band.

SUMMARY OF THE INVENTION

To accomplish the foregoing object, there is provided an improved antenna system in which the system of the reflectors is constructed in such a manner to suppress the cross-polarized component generated due to the antisymmetry of the reflectors at desired frequencies of beams emitted from the radiator.

Thereby, the antenna system of the present invention can provide preferable cross-polarization characteristics in the working frequency bands.

Further, the eccentricities $e_1$ and $e_2$ of the sub-reflectors which satisfy the conditions pursuant to the present invention are determined by not only the geometrical arrangement of the subreflectors (positions of which are represented by, for example, polar coordinates) but also the beam radii of the subreflectors as will be described in detail hereinbelow. That is, the antenna system of the present invention is designed by taking the shades or beam radii of the subreflectors, that is, by taking the wave nature of the electric wave. Thereby, the arrangement of the reflectors is not limited to that in which the focal points of the reflectors are in common with each other, resulting in increase of degrees of freedom in design of the antenna system.

Furthermore, the technique of suppressing the cross-polarized component according to the present invention takes the wave nature into consideration and thus can suppress the cross-polarized component at a given frequency to be used in the antenna system.

BRIEF DESCRIPTION OF THE DRAWINGS

The above and other advantages of the present invention will become more apparent in the following description and the accompanying drawings in which like reference characters and numerals refer to like parts and in which:

FIGS. 2(*a*) and (*b*) and 3 are each illustrative of a relative positional relation among the reflectors and the primary radiator in the conventional antenna systems;

FIG. 4 is a diagram for illustrating the introductions of the conditions of suppressing the cross-polarized component, which conditions are obtained by taking the wave nature of electric or radio wave into consideration.

DESCRIPTION OF THE PREFERRED EMBODIMENTS

Figure 1A:
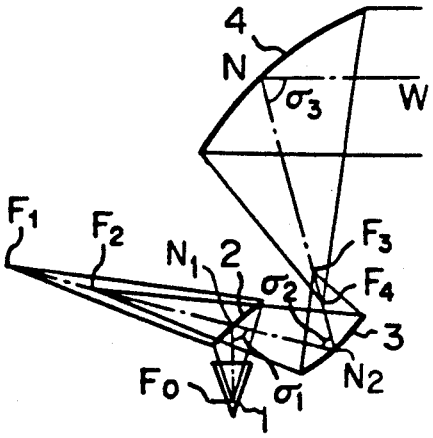
FIGS. 1(*a*) through 1(*h*), 1(*a'*) and 1(*e'*) are each schematically illustrative of a relative positional relation among the reflectors and the primary radiator in an antenna system embodying the present invention.
Figure 1C:
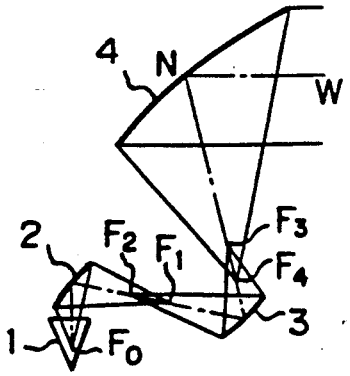
Figure 1B:
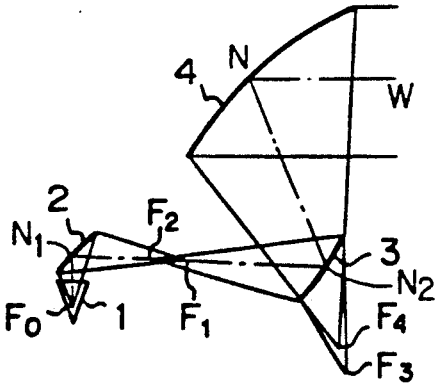
Figure 1D:
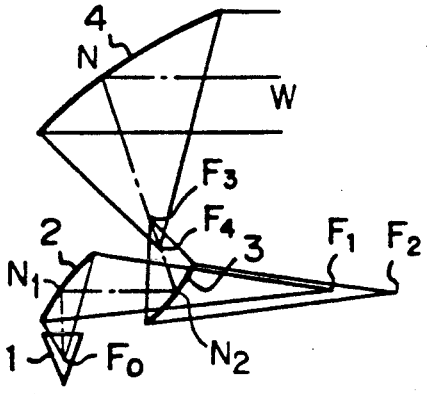
Figure 1E:
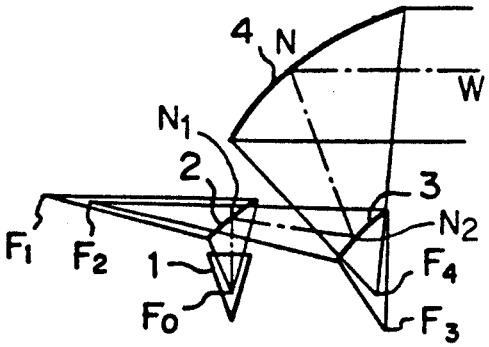

Hereinafter, preferred embodiments of the present invention will be described in detail with reference to the accompanying drawings.

Referring now to FIG. 1(*a*), there is shown an embodiment of the present invention in which a main reflector 4 is disposed on the upper side of a conical horn 1 and first and second subreflectors 2 and 3, as viewed therein. In this figure, a phase center $F_0$ of the conical horn 1 is one of focal points of the first subreflector 2. Further, points $F_2$ and $F_3$ are focal points of the second subreflector 3 and a point $F_4$ is that of the main reflector 4. Moreover, reference characters $N_1$, $N_2$ and N indicate a point at which a light beam emitted from the phase center of the conical horn 1 and propagated along a central axis of the conical horn 1 strikes on the first subreflector 2, a point at which the beam light strikes on the second subreflector 3 and a point at which the beam strikes on the main reflector 4, respectively. Assuming that a point W is disposed on a ray reflected by the main reflector 4 and that the points $F_0$, $N_1$, $N_2$, N and W are disposed on the same plane, it is required for preventing the generation of the cross-polarized component due to the antisymmetry of the reflectors that eccentricities $e_1$ and $e_2$ of the curvatures the first and second subreflectors 2 and 3 satisfy the following conditions (1) and (2):

$$e_1 \approx \{R_3 L_1 d_1 \tan(\sigma_1/2)\}/\{R_1 R_1' d_2 \tan(\sigma_3/2)\} \quad (1)$$

$$e_2 \approx -\{R_3 L_2 \tan(\sigma_2/2)\}/[R_2 R_2' \tan(\sigma_3/2)\{(\epsilon_1 \omega_1^2 d_2 | R_1' + d_1 |/\omega_2^2 d_1 |R_1'|) + (\epsilon_2 |R_2' + d_2|/|R_2'|)\}] \quad (2)$$

where $\omega_1$ and $\omega_2$ are beam radii of the first subreflector 2 and that of the second subreflector 3, respectively, and usually change depending on the frequency of the beam of the electric wave, respectively. Further, $\sigma_1$, $\sigma_2$ and $\sigma_3$ are angles formed by the incident wave into and the reflected waves from the first subreflector 2, the second subreflector 3 and the main reflector 4, respectively. $L_1$ and $L_2$ are a distance between the points $F_0$ and $F_1$ and that between the points $F_2$ and $F_3$. Moreover, $d_1$ and $d_2$ are a distance between the points $N_1$ and $N_2$ and that between the points $N_2$ and N, respectively. Further, $R_1$, $R_2$ and $R_3$ are radii of the curvatures of the wave surface of the incident ray or beam on the first and second subreflectors and main reflector 2, 3 and 4, respectively. Moreover, $R_1'$ and $R_2'$ are radii of the curvature of the wave surfaces of the beam reflected from the first and second subreflectors 2 and 3, respectively. In passing, $\epsilon i$ is obtained by the following equation (3):

$$\epsilon i = \text{sign}\{(1/Ri') + (1/di)\} \quad (3)$$

where i=1 or 2 and where sign (x)=x/|x|.

The above equations (1) and (2) are obtained from the known technical matters in the art.

The derivation of the above equations (1) and (2) is not essential for the instant invention and thus is briefly described hereinafter.

Namely, these equations (1) and (2) can be essentially derived in the following way from an equation (17) described in the article (hereinunder referred to simply as Nakajima) entitled "4. 5, 6 GHz Band Offset Antenna Featuring Low Sidelobe and High Cross Polarization Discrimination" (by Nobuo Nakajima et al., Japan Denshi-Tsushin Gakkai Ronbunshi, vol., J67-B No. 2 (February, 1984), pp. 194–201) by using the results of study described in the article (hereinunder referred to simply as Mizusawa) entitled "Equalizing Parabolic Representation of Multiple Reflector Type Antenna and its Application" (by M. Mizusawa and T. Katagi, Mitsubishi Denki Gihou, vol. 49, No. 11, 1975, pp. 729–732).

First, for simplicity of description, the antenna system of the instant invention is assumed to be as shown in FIG. 4. Further, the focal lengths $\pi_1$ and $\pi_2$ of a first and second subreflectors and the focal length $\pi_3$ of a third or main reflector are defined as follows:

$$\left.\begin{aligned} 1/\zeta_1 &= 1/D_1 - 1/D_1' \\ 1/\zeta_2 &= 1/D_2 - 1/D_2' \\ 1/\zeta_3 &= 1/D_3 - 1/D_3' \end{aligned}\right\} \quad (d1)$$

where Di (i=1, 2 or 3) indicates a distance between a focal point (hereunder referred to as a first focal point) of the i-th reflector, through which an incident beam travels to the i-th reflector, and a center point or vertex of the curved surface of the i-th reflector (namely, a point of the intersection of the curved surface of the i-th reflector and the central beam), and Di' indicates a distance between a focal point (hereunder referred to as a second focal point) of the i-th reflector, through which a reflected beam passes, and the center point of the curved surface of the i-th reflector and further these Di and Di') are taken as negative in case where the corresponding focal points of the i-th reflector are present in the direction in which the beam advances. Further, the beam radii of the first and second subreflectors and main reflectors are denoted by $\rho_1$, $\rho_2$ and $\rho_3$, respectively.

Moreover, angles $\phi_1$, $\phi_2$ and $\phi_3$ are defined as shown in FIG. 4. The maximum magnitude C of the electric field of the cross-polarized component is obtained from the results of study described by using the results of study described in "Nakajima" [especially, equations (16) and (17) described therein] on the basis of the maximum value of the electric field of the primary polarized wave of the emitted pattern as follows:

$$C = (1/\sqrt{2e})|\delta_1 e^{j\theta_1}(\rho_1/\zeta_1)\tan(\phi_1/2) + \delta_2(\rho_2/\zeta_2)\tan(\phi_2/2) + \delta_3 e - j\theta_2(\rho_3/\zeta_3)\tan(\phi_3/2)| \quad \text{(d2)}$$

Furthermore, $$\left.\begin{aligned} e^{j\theta_1} &= (1/u_1)(\kappa_1\sqrt{u_1^2-1}+j) \\ e^{j\theta_2} &= (1/u_2)(\kappa_2\sqrt{u_2^2-1}-j) \\ u_1 &= \pi\rho_1\rho_2/(\lambda\tau_1) \\ u_2 &= \pi\rho_2\rho_3/(\lambda\tau_2) \\ \kappa_1 &= \mathrm{sign}\{(1/D_1') + (1/\tau_1)\} \\ \kappa_2 &= \mathrm{sign}\{(1/D_2') + (1/\tau_2)\} \end{aligned}\right\} \quad \text{(d3)}$$

where $\delta_1=\delta_2=\delta_3=1$ in case that the reflecting surface of the main reflector faces downwardly to the bottom of FIG. 4 as viewed in the figure; and $\delta_1=1$; and $\delta_2=\delta_3=-1$ in case that the reflecting surface of the main reflector face upwardly to the top of the figure. Further, $\lambda$ denotes the wavelength of the beam in free space and $\tau_1$ and $\tau_2$ indicate a distance between the first and second subreflectors which is measured along the path of the central beam and a distance between the second subreflector and the main reflector which is also measured along the path of the central beam. Moreover, the equation (d2) can be modified by using the equation (d3) as follows:

$$\left.\begin{aligned} C &= \sqrt{Cr^2 + Ci^2} \\ Cr &= (\rho_2/\sqrt{2e})\{\delta_1\kappa_1(\rho_1^2/\rho_2^2)(1/\zeta_1)|(D_1'+\tau_1)/D_1'| \\ &\quad \tan(\phi_1/2) + \delta_2(1/\zeta_2)\tan(\phi_2/2) + \\ &\quad \delta_3\kappa_2(1/\zeta_3)|(D_2'+\tau_2)/D_2'|\tan(\phi_3/2)\} \\ Ci &= \{\lambda/(\pi\rho_2\sqrt{2e})\}\{\delta_1(\tau_1/\zeta_1)\tan(\phi_1/2) - \\ &\quad \delta_3(\tau_2/\zeta_3)\tan(\phi_3/2)\} \end{aligned}\right\} \quad \text{(d4)}$$

Furthermore, it is necessary for completely suppressing the cross-polarized component that the maximum magnitude C of the electric field of the cross-polarized component as described in the equations (d4) be equal to zero. Thus, the following equations (d5) and (d6) are to be satisfied:

$$\rho_1^2 = -\{\delta_2(1/\zeta_2)\tan(\phi_2/2) + \delta_3\kappa_2(1/\zeta_3)|(D_2'+\tau_2)/D_2'|\tan(\phi_3/2)\}\rho_2^2/\{\delta_1\kappa_1(1/\zeta_1)|(D_1'+\tau_1)/D_1'|\tan(\phi_1/2)\} \quad \text{(d5)}$$

$$\zeta_3/\zeta_1 = (\delta_3/\delta_1)\{\tau_2\tan(\phi_3/2)\}/\{\tau_1\tan(\phi_1/2)\} \quad \text{(d6)}$$

Furthermore, by deleting $\pi_1$ from the equations (d5) and (d6), $\rho_1$ and $D_1$ are obtained as functions of other parameters as follows:

$$\rho_1^2 = -[\delta_3\kappa_2|(D_2'+\tau_2)/D_2'| + \delta_2(\zeta_3/\zeta_2)\{\tan(\phi_2/2)/\tan(\phi_3/2)\}]\rho_2^2/\{\delta_3\kappa_1(\tau_2/\tau_1)|(D_1'+\tau_1)/D_1'|\} \quad \text{(d7)}$$

-continued $$D_1 = D_1'/[1 + (\delta_3/\delta_1)(D_1'/\zeta_3)(\tau_2/\tau_1)\{\tan(\phi_3/2)/\tan(\phi_1/2)\}] \quad \text{(d8)}$$

Further, the focal lengths $\pi_1$ and $\pi_2$ of the first and second subreflectors are derived from the equations (d5) and (d6) as follows:

$$\left.\begin{aligned} \zeta_1 &= \zeta_3(\delta_1/\delta_3)\{\tau_1\tan(\phi_1/2)/\tau_2\tan(\phi_3/2)\} \\ \zeta_2 &= -\zeta_3/[\{\delta_3\tan(\phi_3/2)/\delta_2\tan(\phi_2/2)\} \\ &\quad \{\kappa_1(\rho_1^2/\rho_2^2)(\tau_2/\tau_1)|(D_1'+\tau_1)/D_1'| + \\ &\quad \kappa_2|(D_2'+\tau_2)/D_2'|\}] \end{aligned}\right\} \quad \text{(d9)}$$

In case where $\zeta i$ (i=1, 2) is positive, the corresponding subreflector is a concave mirror. Further, if negative, the corresponding subreflector is a convex mirror. Moreover, the eccentricities $e_1$ and $e_2$ (each including its sign) of the first and second subreflectors are given by $$\left.\begin{aligned} \overline{e_1} &= \Pi_1\Gamma_1 e_1 = L_1/(D_1' - D_1) \\ \overline{e_2} &= \Pi_2\Gamma_2 e_2 = L_2/(D_2' - D_2) \end{aligned}\right\} \quad \text{(d10)}$$

where $L_1$ and $L_2$ denote the distance between the focal points of the first subreflector and the distance between the focal points of the second subreflector, respectively. Furthermore, the parameter $\pi$ is +1 in case the subreflector is a rotary hyperbolic reflector while −1 in case a rotary elliptic reflector. Moreover, the parameter $\Gamma$ is +1 in case the subreflector is a concave mirror and is −1 in case the subreflector is a convex mirror.

Furthermore, the following equation is derived from the equations (d1), (d9) and (d10), $$\left.\begin{aligned} \overline{e_1} &= \{\delta_1\zeta_3 L_1\tau_1\tan(\phi_1/2)\}/\{\delta_3 D_1 D_1'\tau_2\tan(\phi_3/2)\} \\ \overline{e_2} &= -\{\delta_2\zeta_3 L_2\tan(\phi_2/2)\}/[\delta_3 D_2 D_2'\tan(\phi_3/2) \\ &\quad \{\kappa_1(\rho_1^2/\rho_2^2)(\tau_2/\tau_1)|(D_1'+\tau_1)/D_1'| + \\ &\quad \kappa_2|(D_2'+\tau_2)/D_2'|\}]. \end{aligned}\right\} \quad \text{(d11)}$$

Here, it is to be noted that the angles $\phi i$ (i=1, 2, 3) are within the range from 0 to $\pi$ and that thus, the values of $\tan(\phi i/2)$ are larger than 0. Further, the parameters $\pi i$ and $\Gamma i$ (i=1, 2, 3) are obtained from the equations (d9) and (d11) as follows:

$$\left.\begin{aligned} \Pi_1 &= \mathrm{sign}(D_1)\mathrm{sign}(D_1') \\ \Gamma_1 &= \mathrm{sign}(\delta_1/\delta_3) \\ \Pi_2 &= \mathrm{sign}(D_2)\mathrm{sign}(D_2') \\ \Gamma_2 &= -\mathrm{sign}(\delta_2/\delta_3)\mathrm{sign}(\kappa_1 Z_1 + \kappa_2 Z_2) \end{aligned}\right\} \quad \text{(d12)}$$

where $Z_1$ and $Z_2$ are given by $Z_1=(\rho_1^2\rho_2^2)(\tau_2/\tau_1)|(D_1'+\tau_1)/D_1'|$ $Z_2=|(D_2'+\tau_2)/D_2'|$.

Figure 5:
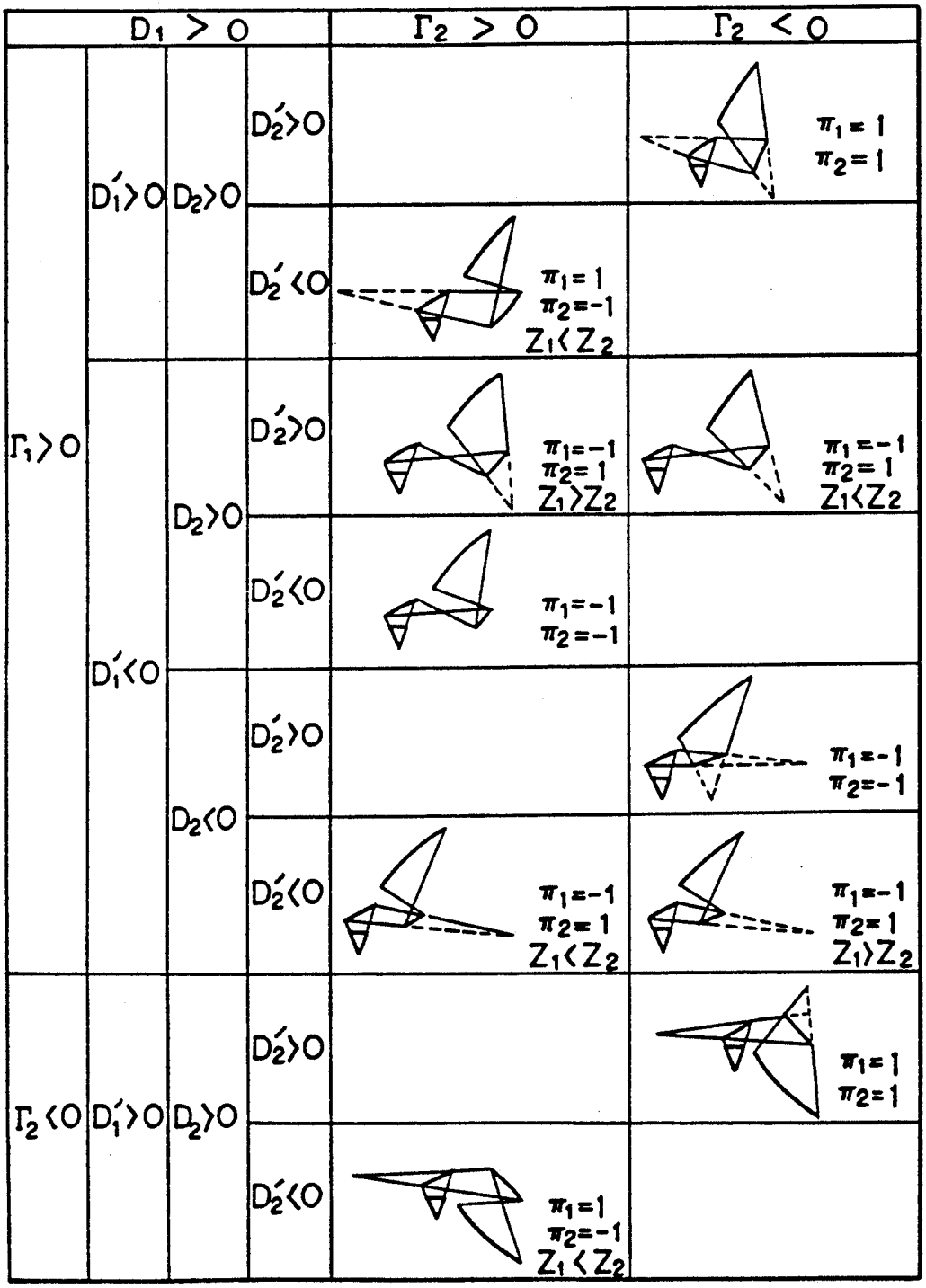
FIG. 5 is a diagram for illustrating possible configurations of three reflectors of the antenna system which can satisfy the conditions of suppressing the cross-polarized component, which conditions are obtained by taking the wave nature of electric or radio waves into consideration.

Thus, possible configurations of three reflectors of the antenna system are obtained by using the equations (d12) and are shown in FIG. 5 for reference.

In such antenna systems, the beams reflected by the main reflector can be practically considered as parallel with each other. Thus, the distance between the second focal point of the subreflector and the vertex of the main reflector $D_3'$ is substantially large in the practical system. That is, $D_3'>>1$ and thus $1/D_3'\simeq 0$. Therefore, in the equation (d1), the focal length $\zeta_3$ of the main reflector can be approximately obtained by the following equations:

$$1/\zeta_3=1/D_3 \quad \text{(d13).}$$

Apparently, the equations (d11) are equivalent to the equations (1) and (2) under the condition expressed by the equation (d13) Here, the derivation of the equations (1) and (2) are thus completed.

Returning to the subject matter of the present invention, the focal lengths $f_1$ and $f_2$ of the subreflectors 2 and 3 are given by the following equations (4) and (5):

$$f_1=f_3d_1\tan(\sigma_1/2)/\{d_2\tan(\sigma_3/2)\} \quad (4)$$

$$f_2=-f_3/[\{\tan(\sigma_2/2)/\tan(\sigma_2/2)\}(\epsilon i\omega_1^2d_2|R_1'+d_1|/\omega_2^2d_1|R_1'|)+(\epsilon_2|R_2'+d_2|/|R_1'|)\}] \quad (5)$$

Each of the subreflectors is a concave mirror if fi (i=1, 2) is positive while each subreflector is a convex mirror if fi is negative. Further, the value of $\sigma i$ (i=1, 2) ranges from 0 to $\pi$. Thus, $\tan(\sigma i/2)>0$.

Here, parameters Pi and $\Delta i$ for representing the shapes and kinds of the reflectors are now introduced for simplicity of description.

First, parameter Pi is defined as follows: if Pi=+1, the shape of the reflector in question is a rotary hyperbolic curvature; and if Pi=−1, the shape is a rotary elliptic curvature.

Next, parameter $\Delta i$ is defined as follows: if $\Delta i=+1$, the reflector is a concave mirror; and if $\Delta i=-1$, the reflector is a convex mirror.

In the above definitions of the parameters Pi and $\Delta i$, in case i=1, the reflector is the first subreflector 2 while it is the second subreflector 3 in case i=2.

Thus, from the equations (1) through (5), we obtain the sets (6) and (7) of equations:

$$\left.\begin{aligned} P_1 &= \text{sign}(R_1)\text{sign}(R_1') \\ \Delta_1 &= +1 \\ P_2 &= \text{sign}(R_2)\text{sign}(R_2') \\ \Delta_2 &= -\text{sign}(\epsilon_1X_1+\epsilon_2X_2) \end{aligned}\right\} \quad (6)$$

$$\left.\begin{aligned} X_1 &= (\omega_1^2d_2/\omega_2^2d_1)|(R_1'+d_1)/R_1'| \\ X_2 &= |(R_2'+d_2)/R_2'| \end{aligned}\right\} \quad (7)$$

Here, all combinations of the parameters Pi and $\Delta i$ satisfying the above conditions (6) and (7) is listed in the Table 1 as shown hereinbelow.

TABLE 1

| | $\Delta_2>0$ | | | $\Delta_2<0$ | | |
|---|---|---|---|---|---|---|
| $P_1$ | 1 | −1 | −1 | 1 | −1 | −1 |
| $P_2$ | −1 | 1 | −1 | 1 | 1 | −1 |

The embodiments of the invention corresponding to Table 1 are shown in FIGS. 1(*a*) through (*h*), respectively. FIG. 1(*a*) shows an embodiment of the present invention corresponding to the combination of the parameters Pi and $\Delta i$ described in the leftmost column of Table 1. FIGS. 1(*b*) and (*d*) show embodiments of the invention corresponding to the second column from the left side of Table 1. Further, FIG. 1(*b*) shows the configuration of the reflectors of the embodiment in case $X_1>X_2$ while FIG. 1(*d*) shows that of the reflectors in case $X_1<X_2$. FIGS. 1(*c*) and (*e*) show embodiments corresponding to the third and fourth columns from the left side of Table 1, respectively. Further, FIGS. 1(*f*) and (*h*) show embodiments corresponding to the fifth column from the left side of Table 1. Moreover, FIG. 1(*f*) shows the embodiment in case $X_1<X_2$ while FIG. 1(*h*) shows that in case $X_1>X_2$. Finally, FIG. 1(*g*) shows an embodiment corresponding to the rightmost column of Table 1.

Next, other preferred embodiments of the present invention will be described with reference to FIGS. 1(*a'*) and (*e'*).

Referring to FIG. 1(*a'*), there is shown another embodiment in which a main reflector 4 is disposed on the lower side of a conical horn 1 and subreflectors 2 and 3. In this figure, points $F_0$, $F_1$, $F_2$, $F_3$, $N_1$, $N_2$, N and W are defined in the same way as in FIG. 1(*a*).

However, in place of the above condition (1) for preventing the generation of the cross-polarized component in the antenna system at a desired frequency on condition that the points $F_0$, $N_1$, $N_2$, N and W are disposed on the same plane, the eccentricity $e_1$ should satisfy the following condition (1').

$$e_1\simeq-\{R_3L_1d_1\tan(\sigma_1/2)\}/\{R_1R_1'd_2\tan(\sigma_3/2)\} \quad (1')$$

where $\sigma_1$, $\sigma_3$, $L_1$, $d_1$, $d_2$, $R_1$ and $R_3$ are defined in the same manner as in the description of the condition (1). Further, it is noted that $\epsilon i$ is given by the above equation (3).

However, in this case, the focal length $f_1$ of the first subreflector is given by the following equation (4').

$$f_1=-\{f_3d_1\tan(\sigma_1/2)\}/\{d_2\tan(\sigma_3/2)\} \quad (4').$$

Further, the focal point $f_2$ of the second subreflector 3 is given by the above equation (5).

Furthermore, the equation (6') is thus obtained from the equations (1'), (2), (4') and (5) in place of the equation (6) above described.

$$\left.\begin{aligned} P_1 &= \text{sign}(R_1)\text{sign}(R_1') \\ \Delta_1 &= -1 \end{aligned}\right\} \quad (6')$$

On the other hand, the equation (7) still holds in this case.

All combinations of the parameters $P_1$, $P_2$ and $\Delta_2$ are listed in Table 2 described below.

TABLE 2

| | $\Delta_2>0$ | $\Delta_2<0$ |
|---|---|---|
| $P_1$ | 1 | 1 |
| $P_2$ | −1 | 1 |

Two Examples of the antenna system according to the present invention corresponding to Table 2 are shown in FIGS. 1(*a'*) and (*e'*). FIG. 1(*a'*) shows an embodiment corresponding to the leftmost column of Table 2, that is, in case $X_1 < X_2$ while FIG. 1(e') shows that corresponding to the rightmost column of Table 2.

Further, although in the above description the antenna system was assumed to use a conical horn as a primary radiator, the antenna system can be provided with any horn having a central axis as a primary radiator.

Moreover, although in the above description each of the main and subreflectors of the antenna system is assumed to have a rotary quadratic surface, the antenna system can be provided with what is called shaped reflectors as the main and subreflectors.

While the invention has been described in detail and with reference to specific embodiments thereof, it will be apparent to one skilled in the art that various changes and modifications can be made therein without departing from the spirit and scope thereof.

What is claimed is:

1. An antenna system having two subreflectors between a primary radiator and a main reflector, said main reflector being disposed above said primary radiator and subreflectors, the primary radiator being operable to radiate a beam along a central axis thereof, wherein the system of the main reflector and the subreflectors is constructed such that a first eccentricity ($e_1$) of a first subreflector ($M_1$) which is nearer along a beam propagation path to the primary radiator than a second subreflector ($M_2$), and a second eccentricity ($e_2$) of the second subreflector ($M_2$) which is nearer along a beam propagation path to the main reflector ($M_3$), are respectively obtained by $$e_1 \simeq \{R_3 L_1 d_1 \tan(\sigma_1/2)\}/\{R_1 R_1' d_2 \tan(\sigma_3/2)\}$$

$$e_2 \simeq -\{R_3 L_2 \tan(\sigma_2/20\}/(R_2 R_2' \tan(\sigma_3/2)\{(\epsilon_1 \omega_1^2 d_2 |R_1' + d_1|/\omega_2^2 d_1 |R_1'|) + (\epsilon_2 |R_2' + d_2|/|R_2'|)\}|)$$

where $\omega_i$ (i=1, 2) is a beam radius of the subreflector $M_i$ (i=1, 2); $\sigma_i$ (i=1, 2, 3) is an angle formed by an incident wave and waves reflected by the main reflector and the subreflectors $M_i$ (i=1, 2, 3); $L_i$ (i=1, 2) is a distance between focal points $F_0$ and $F_1$ of the subreflector $M_1$ and $F_2$ and $F_3$ of subreflector $M_2$; $d_1$ is a distance between the point that a light beam propagating along the point that a light beam propagating along the central axis of the primary radiator strikes first subreflector $M_1$ and the point the light beam strikes second subreflector $M_2$; $d_2$ is a distance between the point that a light beam propagating along the central axis of the primary radiator strikes second subreflector $M_2$ and the point the light beam strikes the main reflector $M_3$; $R_i$ (i=1, 2, 3) is a radius of curvature of a wave surface of an incident beam on the main reflector and the subreflectors $M_i$ (i=1, 2, 3); $R_i'$ (i=1, 2) is the radius of curvature of the wave surface of a reflected beam from the subreflectors $M_i$ (i=1, 2); and $$\epsilon_i = \text{sign}\{(1/R_i') + (1/d_i)\}(i=1, 2).$$

2. An antenna system having two subreflectors between a primary radiator and a main reflector, said main reflector being disposed below said primary radiator and sub-reflectors, said primary radiator being operable to radiate a beam along a central axis thereof, wherein the system of the main reflector and the subreflectors is constructed such that a first eccentricity ($e_1$) of a first subreflector ($M_1$) which is nearer along a beam propagation path to the primary radiator than a second subreflector )$M_2$), and a second eccentricity ($e_2$) of the second subreflector ($M_2$) which is nearer along a beam propagation path to the main reflector ($M_3$), are respectively obtained by $$e_1 \simeq -\{R_3 L_1 d_1 \tan(\sigma_1/2)\}/\{R_1 R_1' d_2 \tan(\sigma_3/2)\}$$

$$e_2 \simeq -\{R_3 L_2 \tan(\sigma_2/2)\}/(|R_2 R_2 \tan(\sigma_3/2)\{(\epsilon_1 \omega_1^2 d_2 |R_1' + d_1|/\omega_2^2 d_1 |R_1'| + (\epsilon_2 |R_2' + d_2|/|R_2'|)\}|)$$

where $\omega_i$ (i=1, 2) is a beam radius of the subreflector $M_i$ (i=1, 2); $\sigma_i$ (i=1, 2, 3) is an angle formed by an incident wave and waves reflected by the main reflector and the subreflectors $M_i$ (i=1, 2, 3); $L_i$ (i=1, 2) is the distance between focal points $F_0$ and $F_1$ of the subreflector $M_1$ and $F_2$ and $F_3$ of subreflector $M_2$; $d_1$ is a distance between the point that a light beam propagating along the central axis of the primary radiator strikes first subreflector $M_1$ and the point the light beam strikes second subreflector $M_2$; $d_2$ is a distance between the point that a light beam propagating along the central axis of the primary radiator strikes second subreflector $M_2$ and the point of the light beam strikes the main reflector $M_3$; $R_i$ (i=1, 2, 3) is a radius of curvature of a wave surface of an incident beam on the main reflector and the subreflectors $M_i$ (i=1, 2, 3); $R_i'$ (i=1, 2) is the radius of curvature of the wave surface of a reflected beam from the subreflectors $M_i$ (i=1, 2); and $$\epsilon_1 = \text{sign}\{(1/R_i') + (1/d_i)\}(i=1, 2).$$

* * * * *